US011845915B2

(12) United States Patent
Lambert et al.

(10) Patent No.: US 11,845,915 B2
(45) Date of Patent: Dec. 19, 2023

(54) ENZYME-CONTAINING DETERGENT COMPOSITION

(71) Applicant: RHODIA OPERATIONS, Paris (FR)

(72) Inventors: Florence Lambert, Paris (FR); Gilda Lizarraga, Chesterfield, NJ (US); Haizhou Zhang, Shanghai (CN)

(73) Assignee: RHODIA OPERATIONS, Paris (FR)

( * ) Notice: Subject to any disclaimer, the term of this patent is extended or adjusted under 35 U.S.C. 154(b) by 0 days.

(21) Appl. No.: 16/632,619

(22) PCT Filed: Jul. 24, 2017

(86) PCT No.: PCT/CN2017/094045
§ 371 (c)(1),
(2) Date: Jan. 21, 2020

(87) PCT Pub. No.: WO2019/018976
PCT Pub. Date: Jan. 31, 2019

(65) Prior Publication Data

US 2020/0140785 A1 May 7, 2020

(51) Int. Cl.

| | |
|---|---|
| ***C11D 1/00*** | (2006.01) |
| ***C11D 1/02*** | (2006.01) |
| ***C11D 3/22*** | (2006.01) |
| ***C11D 3/37*** | (2006.01) |
| ***C11D 3/386*** | (2006.01) |
| ***C11D 11/00*** | (2006.01) |
| ***C11D 1/83*** | (2006.01) |
| *C11D 1/14* | (2006.01) |
| *C11D 1/22* | (2006.01) |
| *C11D 1/72* | (2006.01) |

(52) U.S. Cl.
CPC ..... *C11D 3/3869* (2013.01); *C11D 1/83* (2013.01); *C11D 3/222* (2013.01); *C11D 3/38618* (2013.01); *C11D 3/38627* (2013.01); *C11D 1/146* (2013.01); *C11D 1/22* (2013.01); *C11D 1/72* (2013.01)

(58) Field of Classification Search
CPC .... C11D 1/00; C11D 1/02; C11D 3/22; C11D 3/222; C11D 3/227; C11D 3/228; C11D 3/3796; C11D 3/386; C11D 11/00
See application file for complete search history.

(56) References Cited

U.S. PATENT DOCUMENTS

| | | | | |
|---|---|---|---|---|
| 9,650,593 | B2 | 5/2017 | Panandiker et al. | |
| 2004/0067864 | A1* | 4/2004 | Aubay | D06P 5/08 536/18.7 |
| 2015/0147286 | A1 | 5/2015 | Barrera et al. | |
| 2017/0183452 | A1 | 6/2017 | Panandiker et al. | |
| 2020/0199495 | A1* | 6/2020 | Lambert | C11D 3/505 |

FOREIGN PATENT DOCUMENTS

| | | | |
|---|---|---|---|
| WO | 2011094374 | A1 | 8/2011 |
| WO | 2011123739 | A1 | 10/2011 |
| WO | 2017105891 | A1 | 6/2017 |

* cited by examiner

*Primary Examiner* — Brian P Mruk
(74) *Attorney, Agent, or Firm* — Vorys, Sater Seymour and Pease LLP; Anthony P. Venturino; Maryellen Feehery Hank

(57) ABSTRACT

A method for enhancing the detergent properties of enzymes of an enzyme-containing detergent composition, comprising the step of adding to said composition an amphoteric polysaccharide.

4 Claims, No Drawings

ENZYME-CONTAINING DETERGENT COMPOSITION

The present invention concerns an enzyme-containing detergent composition useful in various applications, particularly in personal care and home care detergents, and a method for enhancing the detergent properties of enzymes of an enzyme-containing detergent composition, comprising the step of adding to said composition an amphoteric polysaccharide.

PRIOR ART

The following discussion of the prior art is provided to place the invention in an appropriate technical context and enable the advantages of it to be more fully understood. It should be appreciated, however, that any discussion of the prior art throughout the specification should not be considered as an express or implied admission that such prior art is widely known or forms part of common general knowledge in the field.

The use of enzymes in detergent formulations is now common in developed countries, with over half of all detergents presently available containing enzymes.

Dirt comes in many forms and includes proteins, starches and lipids. In addition, clothes that have been starched must be freed of the starch. Using detergents in water at high temperatures and with vigorous mixing, it is possible to remove most types of dirt but the cost of heating the water is high and lengthy mixing or beating will shorten the life of clothing and other materials. The use of enzymes allows lower temperatures to be employed and shorter periods of agitation are needed, often after a preliminary period of soaking. In general, enzyme containing detergents remove protein from clothes soiled with blood, milk, sweat, or grass, far more effectively than detergents which do not contain enzymes.

In the field of liquid detergent formulations there exists a constant need to deliver improved cleaning technologies, especially as consumers move towards more ecologically friendly processes such as for example, reduced water utilization for each wash cycle. Different methods have been used for improving catalytic efficiency and/or better stability towards temperature, oxidizing agents and different washing conditions, notably through site-directed and/or random mutagenesis of enzymes for instance with proteases.

Despite the fact that numerous patent publications, reviews and articles have been published, in which enzymes from various microorganisms, for example, the low temperature alkaline proteases from actinomycete (*Nocardiopsis dassonvillei*) and fungal (*Paecilomyces marquandii*) microorganisms, there is still a great need for alternative detergent compositions comprising enzymes, which are suitable for and effective in modifying, degrading and removing materials of different stains, particularly in low or moderate temperature ranges and which are stable in the presence of detergents with highly varying properties. Due to autocatalytic property of some enzymes, the stability during storage is also very important.

Accordingly, there exists the need for formulators to provide detergent formulations which are able to deliver excellent enzymatic cleaning properties, during and following storage of the formulation and which provide excellent dissolution and release of actives during the wash cycle.

Invention

The present invention provides a method for enhancing the detergent properties of enzymes of enzyme-containing compositions that is effective in modifying, degrading and removing materials of different stains, particularly in low or moderate temperature ranges and deliver excellent enzymatic cleaning properties. The present invention also allows production of an enzyme-containing composition that is cost-effectively down-stream processed.

The present invention then concerns a method for enhancing the detergent properties of enzymes of an enzyme-containing detergent composition, comprising the step of adding to said composition an amphoteric polysaccharide.

The present invention also concerns use of an amphoteric polysaccharide for enhancing the detergent properties of enzymes of an enzyme-containing detergent composition.

The present invention further concerns a composition comprising at least:

- a detergent,
- an enzyme having detergent properties, and
- an amphoteric polysaccharide, notably for enhancing the detergent properties of the enzyme.

The method and the composition described herein are useful in various applications, particularly in laundry, fabric care, body wash, hand wash, shampoo, hard-surface cleaning and kitchenware wash.

The method of the invention notably permits to remove protein, starch, and fat or oil stains from fabrics, keratin materials such as hair and skin, hard surfaces, kitchenware and glassware, floors and walls.

In context of the present invention, the detergent properties of enzymes refers notably to stain removal performance that the enzyme is capable of hydrolyzing or removing stain, such as proteinaceous stains for instance, in particular the insoluble substances or material on a substrate. Typically, the wash performance in varying conditions and exposed to varying treatments is measured as "stain removal efficiency" or "stain removal effect" or "degree of cleaning property", meaning a visible and measurable increase of lightness or change in colour of the stained material, e.g. in artificially soiled swatches or test cloths. Lightness or change in colour values can be measured, for example by measuring the colour as reflectance values with a spectrophotometer using L*a*b* colour space coordinates. Fading or removal of stain indicating of the enzyme performance (stain removal efficiency) is calculated for example as $\Delta L^*$, which means lightness value L* of enzyme treated fabric minus lightness value L* of fabric treated with buffer or washing liquor without enzyme (enzyme blank or control).

In context of the present invention, the method for enhancing the detergent properties of enzymes refers to an improvement of wash performance, meaning that the performance of the enzyme in presence of an amphoteric polysaccharide is better or markedly better than the performance of the enzyme in absence of the amphoteric polysaccharide.

The expression "detergent" is used to mean substance or material intended to assist cleaning or having cleaning properties. The term "detergency" indicates presence or degree of cleaning property. The degree of cleaning property can be tested on different stain containing substrate materials or stains or stain mixtures bound to solid, water-insoluble carrier, such as textile fibers or glass. Typical stain material includes blood, milk, ink, egg, grass and sauces. Mixtures of stains for testing purposes are commercially available.

Other characteristics, details and advantages of the invention will emerge even more fully upon reading the description which follows.

Definitions

For convenience, before further description of the present disclosure, certain terms employed in the specification, and examples are collected here. These definitions should be read in the light of the remainder of the disclosure and understood as by a person of skill in the art. The terms used herein have the meanings recognized and known to those of skill in the art, however, for convenience and completeness, particular terms and their meanings are set forth below.

The articles "a", "an" and "the" are used to refer to one or to more than one (i.e., to at least one) of the grammatical object of the article.

The term "and/or" includes the meanings "and", "or" and also all the other possible combinations of the elements connected to this term.

The terms "comprise" and "comprising" are used in the inclusive, open sense, meaning that additional elements may be included. Throughout this specification, unless the context requires otherwise the word "comprise", and variations, such as "comprises" and "comprising", will be understood to imply the inclusion of a stated element or step or group of element or steps but not the exclusion of any other element or step or group of element or steps.

Ratios, concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a temperature range of about 120° C. to about 150° C. should be interpreted to include not only the explicitly recited limits of about 120° C. to about 150° C., but also to include sub-ranges, such as 125° C. to 145° C., 130° C. to 150° C., and so forth, as well as individual amounts, including fractional amounts, within the specified ranges, such as 122.2° C., 140.6° C., and 141.3° C., for example.

The term "between" should be understood as being inclusive of the limits.

It is specified that, in the continuation of the description, unless otherwise indicated, the values at the limits are included in the ranges of values which are given. It should be noted that in specifying any range of concentration, any particular upper concentration can be associated with any particular lower concentration.

As used herein, the term "hydrocarbon group" refers to a group mainly consisting of carbon atoms and hydrogen atoms, which group may be saturated or unsaturated, linear, branched or cyclic, aliphatic or aromatic. The term "hydrocarbyl" used in the description and the claims describes radicals which are based on hydrocarbons with the stated number of carbon atoms and which may be pure hydrocarbon radicals but may also have substituents. Hydrocarbon groups of the present invention may be alkyl groups, alkenyl groups, alkynyl groups, aryl groups, alkylaryl groups, aryalkyl groups, heterocyclic groups, and/or alkylheterocyclic groups.

Hydrocarbon groups of the present invention may be alkyl groups, alkenyl groups, alkynyl groups, aryl groups, alkylaryl groups, aryalkyl groups, heterocyclic groups, and/or alkylheterocyclic groups.

As used herein, the terminology "($C_n$-$C_m$)" in reference to an organic group, wherein n and m are each integers, indicates that the group may contain from n carbon atoms to m carbon atoms per group.

As used herein, "alkyl" should be construed under the ordinary meaning. Alkyl groups include saturated hydrocarbons having one or more carbon atoms, including straight-chain alkyl groups, such as methyl, ethyl, propyl, butyl, pentyl, hexyl, heptyl, octyl, nonyl, decyl, cyclic alkyl groups (or "cycloalkyl" or "alicyclic" or "carbocyclic" groups), such as cyclopropyl, cyclopentyl, cyclohexyl, cycloheptyl, and cyclooctyl, branched-chain alkyl groups, such as isopropyl, tert-butyl, sec-butyl, and isobutyl, and alkyl-substituted alkyl groups, such as alkyl-substituted cycloalkyl groups and cycloalkyl-substituted alkyl groups. The term "aliphatic group" includes organic moieties characterized by straight or branched-chains, typically having between 1 and 22 carbon atoms. In complex structures, the chains may be branched, bridged, or cross-linked. Aliphatic groups include alkyl groups, alkenyl groups, and alkynyl groups.

As used herein, "alkenyl" or "alkenyl group" refers to an aliphatic hydrocarbon radical which can be straight or branched, containing at least one carbon-carbon double bond. Examples of alkenyl groups include, but are not limited to, ethenyl, propenyl, n-butenyl, i-butenyl, 3-methylbut-2-enyl, n-pentenyl, heptenyl, octenyl, decenyl, and the like. The term "alkynyl" refers to straight or branched chain hydrocarbon groups having at least one triple carbon to carbon bond, such as ethynyl.

The term "aryl group" includes unsaturated and aromatic cyclic hydrocarbons as well as unsaturated and aromatic heterocycles containing one or more rings. Aryl groups may also be fused or bridged with alicyclic or heterocyclic rings that are not aromatic so as to form a polycycle, such as tetralin. An "arylene" group is a divalent analog of an aryl group.

The term "heterocyclic group" includes closed ring structures analogous to carbocyclic groups in which one or more of the carbon atoms in the ring is an element other than carbon, for example, nitrogen, sulfur, or oxygen. Heterocyclic groups may be saturated or unsaturated. Additionally, heterocyclic groups, such as pyrrolyl, pyridyl, isoquinolyl, quinolyl, purinyl, and furyl, may have aromatic character, in which case they may be referred to as "heteroaryl" or "heteroaromatic" groups.

It should be noted that a chemical moiety that forms part of a larger compound may be described herein using a name commonly accorded it when it exists as a single molecule or a name commonly accorded its radical. For example, the terms "pyridine" and "pyridyl" are accorded the same meaning when used to describe a moiety attached to other chemical moieties.

DETAILS OF THE INVENTION

Those skilled in the art will be aware that the present disclosure is subject to variations and modifications other than those specifically described. It is to be understood that the present disclosure includes all such variations and modifications. The disclosure also includes all such steps, features, compositions and compounds referred to or indicated in this specification, individually or collectively and any and all combinations of any or more of such steps or features.

Amphoteric Polysaccharides

Suitable, non limitative, examples of polysaccharides include, for example, galactomannans, chitosan, pectin, alginate, hyaluronic acid, agar, xanthan, dextrin, starch, amylose, amylopectin, alternan, gellan, mutan, dextran, pullulan, fructan, gum arabic, carrageenan, glycogen, glycosaminoglycans, murein, xyloglucans and bacterial capsular polysaccharides.

In some embodiments, the polysaccharide include, for example, galactomannans such as guars, including guar derivatives, xanthans, polyfructoses such as levan, starches, including starch derivatives, such as amylopectin, xyloglucans such as tamarind gum and tamarind gum derivatives such as hydroxypropyl tamarind gum, and cellulose, including cellulose derivatives, such as methylcellulose, ethylcellulose, carboxymethylcellulose, hydroxyethylcellulose, cellulose acetate, cellulose acetate butyrate, and cellulose acetate propionate.

Galactomannans are polysaccharides consisting mainly of the monosaccharides mannose and galactose. The mannose-elements form a chain consisting of many hundreds of (1,4)-ß-D-mannopyranosyl-residues, with 1,6 linked-D-galactopyranosyl-residues at varying distances, dependent on the plant of origin. Naturally occurring galactomannans are available from numerous sources, including guar gum, guar splits, locust bean gum and tara gum, flame tree gum and cassia gum. Additionally, galactomannans may also be obtained by classical synthetic routes or may be obtained by chemical modification of naturally occurring galactomannans.

Guar gum notably refers to the mucilage found in the seed of the leguminous plant *Cyamopsis tetragonolobus*. The water soluble fraction (85%) is called "guaran," which consists of linear chains of (1,4)-.β-D mannopyranosyl units-with-D-galactopyranosyl units attached by (1,6) linkages. The ratio of D-galactose to D-mannose in guaran is about 1:2. Guar gum typically has a weight average molecular weight of between 2,000,000 and 5,000,000 Daltons. Guars having a reduced molecular weight, such as, from about 2,000 to about 2,500,000 Daltons are also known.

Guar seeds are composed of a pair of tough, non-brittle endosperm sections, hereafter referred to as "guar splits," between which is sandwiched the brittle embryo (germ).

After dehulling, the seeds are split, the germ (43-47% of the seed) is removed by screening, and the splits are ground. The ground splits are reported to contain about 78-82% galactomannan polysaccharide and minor amounts of some proteinaceous material, inorganic non-surfactant salts, water-insoluble gum, and cell membranes, as well as some residual seedcoat and embryo.

Locust bean gum or carob bean gum is the refined endosperm of the seed of the carob tree, *Ceratonia siliqua*. The ratio of galactose to mannose for this type of gum is about 1:4. Locust bean gum is commercially available.

Tara gum is derived from the refined seed gum of the tara tree. The ratio of galactose to mannose is about 1:3. Tara gum is also commercially available.

Xanthans of interest are xanthan gum and xanthan gel. Xanthan gum is a polysaccharide gum produced by *Xathomonas campestris* and contains D-glucose, D-mannose, D-glucuronic acid as the main hexose units, also contains pyruvate acid, and is partially acetylated.

Levan is a polyfructose comprising 5-membered rings linked through β-2,6 bonds, with branching through β-2,1 bonds. Levan exhibits a glass transition temperature of 138° C. and is available in particulate form. At a molecular weight of 1-2 million, the diameter of the densely-packed spherulitic particles is about 85 nm.

Tamarind (*Tamahndus indica*) is a leguminous evergreen tall tree produced in the tropics. Tamarind gum (tamarind powder or tamarind kernel powder), a xyloglucan polysaccharide, is obtained by extracting and purifying the seed powders, obtained by grinding the seeds of tamarind. The polysaccharide molecule of the tamarind gum consists of a main linear chain of poly-glucose bearing xylose and galactoxylose substituents.

In context of the present invention, the term "amphoteric polysaccharide" means a polysaccharide derivative which comprises at least one anionic substituent group and at least one cationic substituent group, and polysaccharide that may be made amphoteric, for example comprising a quaternizable amine group and/or an acid group.

The amphoteric polysaccharides may be chosen in particular from:

- polysaccharides grafted with units A and B where A denotes a cationic unit derived from a monomeric or polymeric group containing at least one nitrogen atom belonging to a primary, secondary, tertiary or quaternary amine functional group, and B denotes an anionic unit derived from a monomeric or polymeric group containing one or more carboxylic acid, phosphoric acid, phosphonic acid, sulfate or sulfonic acid functional groups;
- polysaccharides grafted with one or more units C, where C denotes a unit derived from a monomeric or polymeric group containing at least one zwitterionic group or carboxybetaines or sulfobetaines;
- polysaccharides grafted with one or more units D, where D denotes a unit derived from a monomeric or polymeric group containing at least one anionic group derived from a monomeric or polymeric group containing one or more carboxylic acid, phosphoric acid, phosphonic acid, sulfate or sulfonic acid functional groups and at least one cationic group containing a primary, secondary, tertiary or quaternary amine functional group.

The amphoteric polysaccharide may additionally contain non-ionic functional groups which may be selected from:

- hydroxy group, such as hydroxyethylated groups and hydroxypropylated groups
- hydroxyalkyl group, such as hydroxymethyl hydroxyethyl, hydroxypropyl or hydroxybutyl.

Processes for making amphoteric polysaccharides are known. In particular, processes for making derivatives of guar gum splits are generally known. Typically, guar splits are reacted with one or more derivatizing agents under appropriate reaction conditions to produce a guar polysaccharide having the desired substituent groups. Suitable derivatizing reagents are commercially available and typically contain a reactive functional group, such as an epoxy group, a chlorohydrin group, or an ethylenically unsaturated group, and at least one other substituent group, such as a cationic, nonionic or anionic substituent group, or a precursor of such a substituent group per molecule, wherein substituent group may be linked to the reactive functional group of the derivatizing agent by bivalent linking group, such as an alkylene or oxyalkylene group. Suitable cationic substituent groups include primary, secondary, or tertiary amino groups or quaternary ammonium, sulfonium, or phosphinium groups. Suitable nonionic substituent groups include hydroxyalkyl groups, such as hydroxypropyl groups. Suitable anionic groups include carboxyalkyl groups, such as carboxymethyl groups. The cationic, nonionic and/or anionic substituent groups may be introduced to the polysaccharide chains via a series of reactions or by simultaneous reactions with the respective appropriate derivatizing agents.

For introduction of the substituent groups into the polysaccharide polymers, the polysaccharide polymers, for instance the guars, may be treated with a crosslinking agent, such for example, borax (sodium tetra borate) is commonly used as a processing aid in the reaction step of the water-splits process to partially crosslink the surface of the guar splits and thereby reduces the amount of water absorbed by the guar splits during processing. Other crosslinkers, such as, for example, glyoxal or titanate compounds, are known.

According to every one of the invention embodiments, the amphoteric polysaccharide is preferably a polysaccharide which is grafted with a cationic unit derived from a monomeric or polymeric group containing at least one nitrogen atom belonging to a primary, secondary, tertiary or quaternary amine functional group, and an anionic unit derived from a monomeric or polymeric group containing one or more carboxylic acid, phosphoric acid, phosphonic acid, sulfate or sulfonic acid functional groups, the amphoteric polysaccharide optionally containing non-ionic functional groups.

Advantageously, the amphoteric polysaccharide is an amphoteric galactomannan, in particular an amphoteric guar. Advantageously, the amphoteric polysaccharide is chosen from:

- carboxymethyl hydroxypropyltrimethylammonium chloride galactomannans, in particular carboxymethyl hydroxypropyltrimethylammonium chloride galactomannans guars;
- carboxymethyl hydroxypropyl hydroxypropyltrimethylammonium chloride galactomannans, in particular carboxymethyl hydroxypropyl hydroxypropyltrimethylammonium chloride guars.

As used herein, the terminology "Degree of Substitution" (DS) in reference to a given type of derivatizing group and a given polysaccharide polymer means the number of the average number of such derivatizing groups attached to each monomeric unit of the polysaccharide polymer. In some embodiments, the amphoteric polysaccharide exhibits a total degree of substitution ("DST") of from about 0.001 to about 3.0, wherein: DST is the sum of the DS for cationic substituent groups ("$DS_{cationic}$"), the DS for nonionic substituent groups ("$DS_{nonionic}$") and the DS for anionic substituent groups ("$DS_{anionic}$"). $DS_{cationic}$, $DS_{nonionic}$, and $DS_{anionic}$ may be measured for instance by 1H-NMR.

In the amphoteric polysaccharides of the present invention:

- $DS_{cationic}$ is preferably from 0.001 to 3, more typically from about 0.001 to about 1.0, and even more typically from about 0.001 to about 0.5, in particular from about 0.001 to about 0.1. Preferably $DS_{cationic}$ is equal to 0.01, 0.02, 0.03, 0.04, 0.05, 0.06, 0.07, 0.08, 0.09 and 0.1 or any range comprised between these values.
- $DS_{anionic}$ may be from about 0.01 to about 3.0, more typically from about 0.001 to about 1.0 and even more typically from about 0.1 to about 0.6, in particular from about 0.01 to about 0.2. Preferably $DS_{anionic}$ is equal to 0.1, 0.12, 0.14, 0.16, 0.18 and 0.2 or any range comprised between these values.
- $DS_{nonionic}$ may be from about 0 to about 3.0, more typically from about 0.001 to about 2.5, and even more typically from about 0.001 to about 1.0.

As used herein, the term "Molar Substitution" or "MS" refers to the number of moles of derivatizing groups per moles of monosaccharide units of the polysaccharide. The molar substitution can be determined by the Zeisel-GC method. The Molar Substitution utilized by the present invention is typically in the range of from about 0.001 to about 3.

Preferably, the amphoteric polysaccharide of the present invention has a $DS_{anionic}$ value greater than or equal to its $DS_{cationic}$ value. More preferably, the amphoteric polysaccharide has a $DS_{anionic}$ value greater than its $DS_{cationic}$ value, in other words, the amphoteric polysaccharide exhibits a net negative charge.

Preferably, the ratio between $DS_{anionic}$ and $DS_{cationic}$ of the amphoteric polysaccharide (absolute value) is from 1:1 to 10:1, more preferably from 1:1 to 5:1.

In some embodiments, the amphoteric polysaccharide such as the amphoteric galactomannan, have a $DS_{anionic}$ value greater than or equal to its $DS_{cationic}$ value and the $DS_{cationic}$ is in the range of from 0.01 to 1.0, more preferably from 0.01 to 0.5, even more preferably from 0.01 to 0.1.

The amphoteric polysaccharide, such as the amphoteric galactomannan, preferably has an average molecular weight (Mw) of between 100,000 Daltons and 3,500,000 Daltons, more preferably between 500,000 Daltons and 2,500,000 Daltons, even more preferably between 1,000,000 Daltons and 2,500,000 Daltons.

In some embodiments, the amphoteric polysaccharide, such as the amphoteric galactomannan, has an average molecular weight of from 1,000,000 Daltons to 2,500,000 Daltons and has a $DS_{cationic}$ of 0.001 to 0.1.

In some embodiments, the amphoteric polysaccharide, such as the amphoteric galactomannan, has an average molecular weight of from 1,000,000 Daltons to 2,500,000 Daltons, has a $DS_{cationic}$ of 0.001 to 0.1 and a $DS_{anionic}$ of from 0.01 to 0.2.

In some embodiments, the amphoteric polysaccharide, such as the amphoteric galactomannan, has an average molecular weight of from 1,000,000 Daltons to 2,500,000 Daltons, and the amphoteric polysaccharide has a $DS_{anionic}$ value greater than its $DS_{cationic}$ value.

In some embodiments, the amphoteric polysaccharide, such as the amphoteric galactomannan, has an average molecular weight of from 1,000,000 Daltons to 2,500,000 Daltons, has a $DS_{cationic}$ of 0.001 to 0.1, and the amphoteric polysaccharide has a $DS_{anionic}$ value greater than its $DS_{cationic}$ value.

In some embodiments, the amphoteric polysaccharide, such as the amphoteric galactomannan, has an average molecular weight of from 1,000,000 Daltons to 2,500,000 Daltons, has a $DS_{cationic}$ of 0.001 to 0.1 and $DS_{anionic}$ of from 0.01 to 0.2, wherein the amphoteric polysaccharide has a $DS_{anionic}$ value greater than its $DS_{cationic}$ value.

The amphoteric polysaccharide may be present in an amount of from 0.01 to 5 wt %, based on the total weight of the detergent composition, preferably, 0.1 to 1 wt %, more preferably from 0.3 to 0.8 wt %.

Detergent

The detergent composition may comprise one or more surfactants as the detergent active ingredient, which may be anionic and/or cationic and/or non-ionic and/or semipolar and/or zwitterionic, or a mixture thereof.

In some embodiments, the detergent composition comprises a mixture of one or more nonionic surfactants and one or more anionic surfactants. The surfactant(s) is typically present at a level of from about 0.1% to 60% by weight, such as about 1% to about 40%, or about 1% to about 20%, or about 3% to about 10%. The surfactant(s) is chosen based on the desired cleaning application, and may include any conventional surfactant(s) known in the art. Preferably, the detergent active ingredient is an anionic surfactant.

When included therein, the detergent composition may usually contain from about 1% to about 40% by weight of an anionic surfactant, such as from about 5% to about 30%, including from about 5% to about 15%, or from about 15% to about 20%, or from about 20% to about 25% of an anionic surfactant.

Non-limiting examples of anionic surfactants include sulfates and sulfonates, in particular, linear alkylbenzenesulfonat.es (LAS), isomers of LAS, branched alkylbenzenesulfonat.es (BABS), phenylalkanesulfonat.es, alpha-olefin-sulfonates (AOS), olefin sulfonates, alkene sulfonates, alkane-2,3-diylbis(sulfates), hydroxyalkanesulfonat.es and disulfonates, alkyl sulfates (AS) such as sodium dodecyl sulfate (SDS), fatty alcohol sulfates (FAS), primary alcohol sulfates (PAS), alcohol ethersulfates (AES or AEOS or FES, also known as alcohol ethoxysulfates or fatty alcohol ether sulfates), secondary alkanesulfonates (SAS), paraffin sulfonates (PS), ester sulfonates, sulfonated fatty acid glycerol esters, alpha-sulfo fatty acid methyl esters (alpha-SFMe or SES) including methyl ester sulfonate (MES), alkyl- or alkenylsuccinic acid, dodecenyl/tetradecenyl succinic acid (DTSA), fatty acid derivatives of amino acids, diesters and monoesters of sulfo-succinic acid or salt of fatty acids (soap), and combinations thereof.

The anionic surfactant may include alkyl ether sulphates, soaps, fatty acid ester sulphonates, alkylamide sulfates, alkyl benzene sulphonates, sulphosuccinate esters, primary alkyl sulphates, olefin sulphonates, paraffin sulphonates and organic phosphate. Preferred anionic surfactants are the alkali and alkaline earth metal salts of fatty acid carboxylates, fatty alcohol sulphates, preferably primary alkyl sulfates, more preferably they are ethoxylated, for example alkyl ether sulphates; alkylbenzene sulphonates, alkyl ester fatty acid sulphonates, especially methyl ester fatty acid sulphonates and mixtures thereof.

Particular anionic surfactants which can be mentioned are alkyl ester sulfonates of formula R'—CH($SO_3$M)-COOR", in which R' represents a $C_8$-$C_{20}$ and preferably $C_{10}$-$C_{16}$ alkyl radical, R" represents a $C_1$-$C_6$ and preferably $C_1$-$C_3$ alkyl radical and M represents an alkali metal (sodium, potassium or lithium) cation, a substituted or unsubstituted ammonium (methyl-, dimethyl-, trimethyl- or tetramethylammonium, dimethylpiperidinium, etc.) or an alkanolamine derivative (monoethanolamine, diethanolamine, triethanolamine, etc.), Mention may be made most particularly of methyl ester sulfonates in which the radical R' is $C_{14}$-$C_{16}$;

alkyl sulfates of formula R'$OSO_3$M, in which R' represents a $C_5$-$C_{24}$ and preferably $C_{10}$-$C_{18}$ alkyl or hydroxyalkyl radical, M representing a hydrogen atom or a cation of the same definition as above, and also the ethoxylenated (EO) and/or propoxylenated (PO) derivatives thereof, containing on average from 0.5 to 30 and preferably from 0.5 to 10 EO and/or PO units;

alkylamide sulfates of formula R'CONHR"$OSO_3$M in which R' represents a $C_2$-$C_{22}$ and preferably $C_6$-$C_{20}$ alkyl radical, R" represents a $C_2$-$C_3$ alkyl radical, M representing a hydrogen atom or a cation of the same definition as above, and also the ethoxylenated (EO) and/or propoxylenated (PO) derivatives thereof, containing on average from 0.5 to 60 EO and/or PO units;

saturated or unsaturated $C_8$-$C_{24}$ and preferably $C_{14}$-$C_{20}$ fatty acid salts, $C_9$-$C_{20}$ alkylbenzenesulfonates, primary or secondary $C_8$-$C_{22}$ alkylsulfonates, alkylglyceryl sulfonates, sulfonated polycarboxylic acids, paraffin sulfonates, N-acyl N-alkyltaurates, alkyl phosphates, isethionates, alkyl succinamates, alkyl sulfosuccinates, sulfosuccinate monoesters or diesters, N-acyl sarcosinates, alkylglycoside sulfates, polyethoxycarboxylates; the cation being an alkali metal (sodium, potassium or lithium), a substituted or unsubstituted ammonium residue (methyl-, dimethyl-, trimethyl- or tetramethylammonium, dimethylpiperidinium, etc.) or an alkanolamine derivative (monoethanolamine, diethanolamine, triethanolamine, etc.

When included therein, the detergent composition may usually contain from about from about 0.1% to about 20% by weigh of a cationic surfactant, for example from about 0.1% to about 10%, in particular from about 0.1% to about 5%, from about 0.1% to about 2%.

A variety of quaternary ammonium cationic surfactant may be utilized as the cationic surfactant for the present invention; however acyclic quaternary surfactants are preferred. For example, useful quaternary synthetic surfactants that are acyclic include linear alkyl, branched alkyl, hydroxyalkyl, oleylalkyl, acyloxyalkyl, diamidoamine, or diester quaternary ammonium compounds. The preferred quaternary surfactants for use in the present invention are waxy solids or are highly viscous at ambient temperature such that the material can be melted and applied hot to the substrate, and these may include traditional tetraalkyl materials or ester quaternaries, or combinations of the two types. It may be preferred that the quaternary ammonium cationic surfactant is a fabric softening agent. It may also be preferred that the quaternary ammonium cationic surfactant is an anti-static agent.

Non-limiting examples of cationic surfactants include alkyldimethylethanolamine quat (ADMEAQ), cetyltrimethylammonium bromide (CTAB), dimethyldistearylammonium chloride (DSDMAC), and alkylbenzyldimethylammonium, alkyl quaternary ammonium compounds, alkoxylated quaternary ammonium (AQA) compounds, ester quats, and combinations thereof.

When included therein, the detergent composition may usually contain from about 0.2% to about 40% by weight of a nonionic surfactant, for example from about 0.5% to about 30%, in particular from about 1% to about 20%, from about 3% to about 10%, such as from about 3% to about 5%, from about 8% to about 12%, or from about 10% to about 12%. Non-limiting examples of nonionic surfactants include alcohol ethoxylates (AE or AEO), alcohol propoxylates, propoxylated fatty alcohols (PFA), alkoxylated fatty acid alkyl esters, such as ethoxylated and/or propoxylated fatty acid alkyl esters, alkylphenol ethoxylates (APE), nonylphenol ethoxylates (NPE), alkylpolyglycosides (APO), alkoxylated amines, fatty acid monoethanolamides (FAM), fatty acid diethanolamides (FADA), ethoxylated fatty acid monoethanolamides (EFAM), propoxylated fatty acid monoethanolamides (PFAM), polyhydroxyalkyl fatty acid amides, or /V-acyl /V-alkyl derivatives of glucosamine (glucamides, GA, or fatty acid glucamides, FAGA), as well as products available under the trade names SPAN and TWEEN, and combinations thereof.

When included therein, the detergent composition may usually contain from about 0% to about 20% by weight of a semipolar surfactant. Non-limiting examples of semipolar surfactants include amine oxides (AO) such as alkyldimethylamineoxide, /V-(coco alkyl)-/V,/V-dimethylamine oxide and N-(tallow-alkyl)-/V,/V-bis(2-hydroxyethyl)amine oxide, and combinations thereof.

When included therein, the detergent composition may usually contain from about 0% to about 20% by weight of a zwitterionic surfactant. Non-limiting examples of zwitterionic surfactants include betaines such as alkyldimethylbetaines, sulfobetaines, and combinations thereof.

Enzymes

According to the present invention, the detergent composition contains an enzyme. Enzymes can perform two main roles in the detergent composition: effect stain removal and provide colour and fabric care.

The enzyme is preferably selected from the group constituted by: hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. Preferably, the enzymes are proteases, amylases and lipases.

The most commonly used enzymes are proteases (break down protein), amylases (break down starch—a type of carbohydrate) and lipases (break down fats).

Preferred enzymes could include a protease. Suitable proteases include those of bacterial, fungal, plant, viral or animal origin e.g. vegetable or microbial origin. Microbial origin is preferred. Chemically modified or protein engineered mutants are included. It may be an alkaline protease, such as a serine protease or a metalloprotease. A serine protease may for example be of the S1 family, such as trypsin, or the S8 family such as subtilisin. A metalloproteases protease may for example be a thermolysin from e.g. family M4 or other metalloprotease such as those from M5, M7 or M8 families.

Suitable proteases include metalloproteases and serine proteases, including neutral or alkaline microbial serine proteases, such as subtilisins (EC 3.4.21.62). In one aspect, such suitable protease may be of microbial origin. The suitable proteases include chemically or genetically modified mutants of the aforementioned suitable proteases. In one aspect, the suitable protease may be a serine protease, such as an alkaline microbial protease or/and a trypsin-type protease. Examples of suitable neutral or alkaline proteases include:

(a) subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii.*

(b) trypsin-type or chymotrypsin-type proteases, such as trypsin (e.g., of porcine or bovine origin), including *Fusarium* protease and chymotrypsin proteases derived from Cellumonas.

(c) metalloproteases, including those derived from *Bacillus amyloliquefaciens.*

(d) subtilisin proteases derived from the *Bacillus* sp TY-145, NCIMB 40339.

Preferred proteases include those derived from *Bacillus gibsonii, Bacillus amyloliquefaciens, Bacillus* sp. TY-145 or *Bacillus Lentus.*

Examples of useful proteases are the variants described in: WO92/19729, WO96/034946, WO98/20115, WO98/20116, WO99/011768, WO01/44452, WO03/006602, WO04/03186, WO04/041979, and WO07/006305.

Suitable commercially available protease enzymes include those sold under the trade names Alcalase®, Savinase®, Primase®, Durazym®, Polarzyme®, Kannase®, Liquanase®, Liquanase Ultra®, Savinase Ultra®, Ovozyme®, Neutrase®, Blaze®, Everlase® and Esperase® by Novozymes A/S, those sold under the tradename Maxatase®, Maxacal®, Maxapem®, Properase®, Purafect®, Purafect Prime®, Purafect Ox®, FN3®, FN4®, Excellase®, Ultimase®, Purafect OXP® and the Preferenz P® series by DuPont International Biosciences, those sold under the tradename Opticlean® and Optimase® by Solvay Enzymes, those available from BASF, namely BLAP, BLAP R, BLAP X and BLAP F49-all from BASF; and KAP (*Bacillus alkalophilus* subtilisin) from Kao.

Suitable alpha-amylases include those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375, DSM 12368, DSMZ no. 12649, KSM AP1378, KSM K36 or KSM K38.

Suitable commercially available alpha-amylases include DURAMYL®, LIQUEZYME®, TERMAMYL®, TERMAMYL ULTRA®, NATALASE®, SUPRAMYL®, STAINZYME®, STAINZYME PLUS®, EVEREST®, FUNGAMYL® and BAN® (Novozymes A/S), KEMZYM® AT 9000 from Biozym Biotech Trading GmbH, RAPIDASE®, PURASTAR®, ENZYSIZE®, OPTISIZE HT PLUS®, POWERASE® and PURASTAR OXAM®, PREFERENZ® S series, including PREFERENZ S1000 and PREFERENZ S110 (DuPont) and KAM® (KaoIn one aspect, suitable amylases include NATALASE®, EVEREST®, PREFERENZ S1000®, STAINZYME® and STAINZYME PLUS® and mixtures thereof.

In some embodiments, the enzymes may be selected from the group consisting of: lipases, including "first cycle lipases". In some embodiments, the lipase is a first-wash lipase, preferably a variant of the wild-type lipase from *Thermomyces lanuginosus.*

Preferred lipases would include those sold under the tradenames Lipex®, Lipoclean®, Calipso® and Lipolex®.

Other preferred enzymes include fungal and microbial-derived endoglucanases exhibiting endo-beta-1,4-glucanase activity (E.C. 3.2.1.4). Suitable endoglucanases are sold under the tradenames Celluclean®, Carezyme®, Celluzyme®, Carezyme Premium® and Whitezyme® (Novozymes A/S).

Other preferred enzymes include pectate lyases sold under the tradenames Pectawash®, Pectaway®, Xpect® and mannanases sold under the tradenames Mannaway® (all from Novozymes A/S), and Preferenz F® and Purabrite® (DuPont Suitable perhydrolases are capable of catalyzing a perhydrolysis reaction that results in the production of a peracid from a carboxylic acid ester (acyl) substrate in the presence of a source of peroxygen (e.g., hydrogen peroxide). While many enzymes perform this reaction at low levels, perhydrolases exhibit a high perhydrolysis:hydrolysis ratio, often greater than 1. Suitable perhydrolases may be of plant, bacterial or fungal origin. Chemically modified or protein engineered mutants are included. Examples of useful perhydrolases include naturally occurring *Mycobacterium* perhydrolase enzymes, or variants thereof. An exemplary enzyme is derived from *Mycobacterium smegmatis.*

Suitable oxidases and peroxidases (or oxidoreductases) include various sugar oxidases, laccases, peroxidases and haloperoxidases. Suitable peroxidases include those comprised by the enzyme classification EC 1.11.1.7, as set out by the Nomenclature Committee of the International Union of Biochemistry and Molecular Biology (IUBMB), or any fragment derived therefrom, exhibiting peroxidase activity. Suitable peroxidases include those of plant, bacterial or fungal origin. Chemically modified or protein engineered mutants are included. Examples of useful peroxidases include peroxidases from *Coprinopsis*, e.g., from *C. cinerea* and variants thereof.

Oxidases according to the invention include, in particular, any laccase enzyme comprised by the enzyme classification EC 1.10.3.2, or any fragment derived therefrom exhibiting laccase activity, or a compound exhibiting a similar activity, such as a catechol oxidase (EC 1.10.3.1), an o-aminophenol oxidase (EC 1.10.3.4), or a bilirubin oxidase (EC 1.3.3.5).

Preferred laccase enzymes are enzymes of microbial origin. The enzymes may be derived from plants, bacteria or fungi (including filamentous fungi and yeasts).

Suitable examples from fungi include a laccase derivable from a strain of *Aspergillus, Neurospora*, e.g., *N. crassa, Podospora, Botrytis, Collybia, Fomes, Lentinus, Pleurotus, Trametes*, e.g., *T. villosa* and *T. versicolor, Rhizoctonia*, e.g., *R. solani, Coprinopsis*, e.g., *C. cinerea, C. comatus, C. friesii*, and *C. plicatilis, Psathyrella*, e.g., *P. condelleana, Panaeolus*, e.g., *P. papilionaceus, Myceliophthora*, e.g., *M. thermophila, Schytalidium*, e.g., *S. thermophilum, Polyporus*, e.g., *P. pinsitus, Phlebia*, e.g., *P. radiata* or *Coriolus*, e.g., *C. irsutus*).

Suitable examples from bacteria include a laccase derivable from a strain of *Bacillus*. A laccase derived from *Coprinopsis* or *Myceliophthora* is preferred; in particular a laccase derived from *Coprinopsis cinerea*; or from *Myceliophthora thermophila.*

Examples of other oxidases include, but are not limited to, amino acid oxidase, glucose oxidase, lactate oxidase, galactose oxidase, polyol oxidase and aldose oxidase. Oxidases and their corresponding substrates may be used as hydrogen peroxide generating enzyme systems, and thus a source of hydrogen peroxide. Several enzymes, such as peroxidases, haloperoxidases and perhydrolases, require a source of hydrogen peroxide.

The enzyme may be in liquid form which can be dispersed in the detergent composition. The enzyme may also be added in a solid form or as a capsule. Solid forms would include granules that can be made by fluid bed coating such as layered granules. Preferably said microcapsules and granules are coated with a polymer that provides triggered release via an ionic strength trigger such that said granule and/or capsule is stable in product but upon dilution in water will release its enzyme payload. Examples of such polymeric coatings include cellulose derivatives, such as hydroxypropyl methyl cellulose derivatives, particularly hydroxyl propyl methyl cellulose phthalate and cellulose acetate phthalate. A further preferred polymeric coating is polyvinyl alcohol. It is further preferred that any capsules and/or granules are density-matched to the surrounding liquid matrix to promote stability and prevent settling out of a visible phase. In a further aspect the enzymes can be added as capsules and/or microcapsules derived from interfacial polymerization reaction of a polyamine, preferably a branched polyamine. Said microcapsules can be made by reaction of polyamines, such as those sold under the Lupasol tradename by BASF with an acid chloride.

For the granules preferred particle sizes are from 50 to 1000 μm, preferable from 50 to 500 μm, most preferably from 100-250 μm. For the capsules preferred particle sizes are from 1 to 1000 μm, preferably 5 to 200 μm, most preferably from 10 to 100 μm.

The enzyme may be present in an amount of from 0.01 to 5 wt %, based on the total weight of the detergent composition, preferably, 0.1 to 2 wt %, more preferably from 0.5 to 1.5 wt %.

Builders and Co-Builders

The detergent composition may further contain about 0-65% by weight, such as about 5% to about 50% of a detergent builder or co-builder, or a mixture thereof. In a washing detergent, the level of builder is typically 40-65%, particularly 50-65%. The builder and/or co-builder may particularly be a chelating agent that forms water-soluble complexes with Ca and Mg. Any builder and/or co-builder known in the art for use in laundry cleaning detergents may be utilized. Non-limiting examples of builders include zeolites, diphosphates (pyrophosphates), triphosphates such as sodium triphosphate (STP or STPP), carbonates such as sodium carbonate, soluble silicates such as sodium metasilicate, layered silicates (e.g., SKS-6 from Hoechst), ethanolamines such as 2-aminoethan-1-ol (MEA), diethanolamine (DEA, also known as 2,2'-iminodiethan-1-ol), triethanolamine (TEA, also known as 2,2',2"-nitrilotriethan-1-ol), and (carboxymethyl)inulin (CMI), and combinations thereof.

The detergent composition may also contain 0-50% by weight, such as about 5% to about 30%, of a detergent co-builder. The detergent composition may include a co-builder alone, or in combination with a builder, for example a zeolite builder. Non-limiting examples of co-builders include homopolymers of polyacrylates or copolymers thereof, such as poly(acrylic acid) (PAA) or copoly(acrylic acid/maleic acid) (PAA PMA). Further non-limiting examples include citrate, chelators such as aminocarboxylates, aminopolycarboxylates and phosphonates, and alkyl- or alkenylsuccinic acid. Additional specific examples include 2,2',2"-nitrilotriacetic acid (NTA), ethylenediaminetetraacetic acid (EDTA), diethylenetriaminepentaacetic acid (DTPA), iminodisuccinic acid (IDS), ethylenediamine-/V,/V'-disuccinic acid (EDDS), methylglycinediacetic acid (MGDA), glutamic acid-/V,/V-diacetic acid (GLDA), 1-hydroxyethane-1,1-diphosphonic acid ethyl enediaminetetra (methylenephosphonic acid) (EDTMPA), diethylenetriaminepentakis(methylenephosphonic acid) (DTMPA or DTPMPA), N-(2-hydroxyethyl)iminodiacetic acid (EDG), aspartic acid-/V-monoacetic acid (ASMA), aspartic acid-Λ/,/V-di acetic acid (ASDA), aspartic acid-/V-monopropionic acid (ASMP), iminodisuccinic acid (IDA), /V-(2-sulfomethyl)-aspartic acid (SMAS), /V-(2-sulfoethyl)-aspartic acid (SEAS), /V-(2-sulfomethyl)-glutamic acid (SMGL), /V-(2-sulfoethyl)-glutamic acid (SEGL), /V-methyliminodiacetic acid (Ml DA), a-alanine-/V,/V-diacetic acid (a-ALDA), serine-/V,/V-diacetic acid (SEDA), isoserine-/V,/V-diacetic acid (ISDA), phenylalanine-/V,/V-diacetic acid (PHDA), anthranilic acid-/V,/V-diacetic acid (ANDA), sulfanilic acid-/V,/V-diacetic acid (SLDA), taurine-/V,/V-diacetic acid (TUDA) and sulfomethyl-/V,/V-diacetic acid (SMDA), /V-(2-hydroxyethyl)ethylenediamine-/V,/V',/V"-triacetic acid (HEDTA), diethanolglycine (DEG), diethylenetriamine penta(methylenephosphonic acid) (DTPMP), aminotris(methylenephosphonic acid) (ATMP), and combinations and salts thereof. Further exemplary builders and/or co-builders are described in, e.g., WO 09/102854, U.S. Pat. No. 5,977,053.

Bleaching Systems

The detergent composition may contain 0-30% by weight, such as about 1% to about 20%, of a bleaching system. Any bleaching system known in the art for use in laundry cleaning detergents may be utilized. Suitable bleaching system components include bleaching catalysts, photobleaches, bleach activators, sources of hydrogen peroxide such as sodium percarbonate, sodium perborates and hydrogen peroxide-urea (1:1), preformed peracids and mixtures thereof. Suitable preformed peracids include, but are not limited to, peroxycarboxylic acids and salts, diperoxydicarboxylic acids, perimidic acids and salts, peroxymonosulfuric acids and salts, for example, Oxone®, and mixtures thereof. Non-limiting examples of bleaching systems include peroxide-based bleaching systems, which may comprise, for example, an inorganic salt, including alkali metal salts such as sodium salts of perborate (usually mono- or tetra-hydrate), percarbonate, persulfate, perphosphate, persilicate salts, in combination with a peracid-forming bleach activator. The term bleach activator is meant herein as a compound which reacts with hydrogen peroxide to form a peracid via perhydrolysis. The peracid thus formed constitutes the activated bleach.

Preferably the bleach component comprises a source of peracid in addition to bleach catalyst, particularly organic bleach catalyst. The source of peracid may be selected from (a) pre-formed peracid; (b) percarbonate, perborate or persulfate salt (hydrogen peroxide source) preferably in combination with a bleach activator; and (c) perhydrolase enzyme and an ester for forming peracid in situ in the presence of water in a textile or hard surface treatment step.

Polymers

The detergent composition may contain 0-10% by weight, such as 0.5-5%, 2-5%, 0.5-2% or 0.2-1% of a polymer. Any polymer known in the art for use in detergents may be utilized. The polymer may function as a co-builder as mentioned above, or may provide antiredeposition, fiber protection, soil release, dye transfer inhibition, grease cleaning and/or anti-foaming properties. Some polymers may have more than one of the above-mentioned properties and/or more than one of the below-mentioned motifs. Exemplary polymers include (carboxymethyl)cellulose (CMC), polyvinyl alcohol) (PVA), poly(vinylpyrrolidone) (PVP), poly(ethyleneglycol) or poly(ethylene oxide) (PEG), ethoxylated poly(ethyleneimine), carboxymethyl inulin (CMI), and polycarboxylates such as PAA, PAA PMA, poly-aspartic acid, and lauryl methacrylate/acrylic acid copolymers, hydrophobically modified CMC (HM-CMC) and silicones, copolymers of terephthalic acid and oligomeric glycols, copolymers of poly(ethylene terephthalate) and poly(oxyethene terephthalate) (PET-POET), PVP, poly (vinylimidazole) (PVI), poly(vinylpyridine-/V-oxide) (PVPO or PVPNO) and polyvinylpyrrolidone-vinylimidazole (PVPVI). Further exemplary polymers include sulfonated polycarboxylates, polyethylene oxide and polypropylene oxide (PEO-PPO) and diquaternium ethoxy sulfate. Other exemplary polymers are disclosed in, e.g., WO2006/130575. Salts of the above-mentioned polymers are also contemplated.

Fabric Hueing Agents

The detergent composition of the present invention may also include fabric hueing agents such as dyes or pigments, which when formulated in detergent compositions can deposit onto a fabric when said fabric is contacted with a wash liquor comprising said detergent composition and thus altering the tint of said fabric through absorption/reflection of visible light. Fluorescent whitening agents emit at least some visible light. In contrast, fabric hueing agents alter the tint of a surface as they absorb at least a portion of the visible light spectrum. Suitable fabric hueing agents include dyes and dye-clay conjugates, and may also include pigments. Suitable dyes include small molecule dyes and polymeric dyes. Suitable small molecule dyes include small molecule dyes selected from the group consisting of dyes falling into the Colour Index (C.I.) classifications of Direct Blue, Direct Red, Direct Violet, Acid Blue, Acid Red, Acid Violet, Basic Blue, Basic Violet and Basic Red, or mixtures thereof, for example as described in WO2005/03274, WO2005/03275, WO2005/03276 and EP1876226 (hereby incorporated by reference). The detergent composition preferably comprises from about 0.00003 wt % to about 0.2 wt %, from about 0.00008 wt % to about 0.05 wt %, or even from about 0.0001 wt % to about 0.04 wt % fabric hueing agent. The composition may comprise from 0.0001 wt % to 0.2 wt % fabric hueing agent, this may be especially preferred when the composition is in the form of a unit dose pouch. Suitable hueing agents are also disclosed in, e.g. WO 2007/087257 and WO2007/087243

Adjunct Materials

Any detergent components known in the art, notably for use in laundry cleaning detergents may also be utilized. Other optional detergent components include anti-corrosion agents, anti-shrink agents, anti-soil redeposition agents, anti-wrinkling agents, bactericides, binders, corrosion inhibitors, disintegrants/disintegration agents, dyes, enzyme stabilizers (including boric acid, borates, CMC, and/or polyols such as propylene glycol), fabric conditioners including clays, fillers/processing aids, fluorescent whitening agents/optical brighteners, foam boosters, foam (suds) regulators, perfumes, soil-suspending agents, softeners, suds suppressors, tarnish inhibitors, and wicking agents, either alone or in combination. Any ingredient known in the art for use in laundry cleaning detergents may be utilized. The choice of such ingredients is well within the skill of the artisan.

The detergent composition of the present invention can also contain dispersants. In particular powdered detergents may comprise dispersants. Suitable water-soluble organic materials include the homo- or co-polymeric acids or their salts, in which the polycarboxylic acid comprises at least two carboxyl radicals separated from each other by not more than two carbon atoms. Suitable dispersants are for example described in Powdered Detergents, Surfactant science series volume 71, Marcel Dekker, Inc.

The detergent composition of the present invention may also include one or more dye transfer inhibiting agents. Suitable polymeric dye transfer inhibiting agents include, but are not limited to, polyvinylpyrrolidone polymers, polyamine /V-oxide polymers, copolymers of N-vinylpyrrolidone and/V-vinylimidazole, polyvinyloxazolidones and polyvinylimidazoles or mixtures thereof. When present in a subject composition, the dye transfer inhibiting agents may be present at levels from about 0.0001% to about 10%, from about 0.01% to about 5% or even from about 0.1% to about 3% by weight of the composition.

The detergent composition of the present invention may preferably contain additional components that may tint articles being cleaned, such as fluorescent whitening agent or optical brighteners. Where present the brightener is preferably at a level of about 0.01% to about 0.5%. Any fluorescent whitening agent suitable for use in a laundry detergent composition may be used in the composition of the present invention. The most commonly used fluorescent whitening agents are those belonging to the classes of diaminostilbene-sulfonic acid derivatives, diarylpyrazoline derivatives and bisphenyl-distyryl derivatives.

The detergent composition of the present invention may also include one or more soil release polymers which aid the removal of soils from fabrics such as cotton and polyester based fabrics, in particular the removal of hydrophobic soils from polyester based fabrics. The soil release polymers may for example be nonionic or anionic terephthalate based polymers, polyvinyl caprolactam and related copolymers, vinyl graft copolymers, polyester polyamides see for example Chapter 7 in Powdered Detergents, Surfactant science series volume 71, Marcel Dekker, Inc. Another type of soil release polymers are amphiphilic alkoxylated grease cleaning polymers comprising a core structure and a plurality of alkoxylate groups attached to that core structure. The core structure may comprise a polyalkylenimine structure or a polyalkanolamine structure as described in detail in WO2009/087523. Furthermore random graft co-polymers are suitable soil release polymers. Suitable graft co-polymers are described in more detail in WO2007/138054, WO2006/108856 and WO2006/113314.

The detergent composition of the present invention may also include one or more anti-redeposition agents such as carboxymethylcellulose (CMC), polyvinyl alcohol (PVA), polyvinylpyrrolidone (PVP), polyoxyethylene and/or polyethyleneglycol (PEG), homopolymers of acrylic acid, copolymers of acrylic acid and maleic acid, and ethoxylated polyethyleneimines. The cellulose based polymers described under soil release polymers above may also function as anti-redeposition agents.

The detergent composition of the present invention may also include one or more rheology modifiers, structurants or thickeners, as distinct from viscosity reducing agents. The rheology modifiers are selected from the group consisting of non-polymeric crystalline, hydroxy-functional materials, polymeric rheology modifiers which impart shear thinning characteristics to the aqueous liquid matrix of a liquid detergent composition. The rheology and viscosity of the detergent can be modified and adjusted by methods known in the art, for example as shown in EP 2169040.

Other suitable adjunct materials include, but are not limited to, anti-shrink agents, anti-wrinkling agents, bactericides, binders, carriers such as oily materials and water, dyes, enzyme stabilizers, fabric softeners, fillers, foam regulators, hydrotropes, perfumes, pigments, sod suppressors, solvents, and structurants for liquid detergents and/or structure elasticizing agents.

Application

The detergent composition of the invention may be in any convenient form, e.g., a bar, a homogenous tablet, a tablet having two or more layers, a pouch having one or more compartments, a regular or compact powder, a granule, a paste, a gel, or a regular, compact or concentrated liquid. Preferably, the detergent composition is in liquid form, such as a gel, a regular, compact or concentrated liquid.

Pouches can be configured as single or multicompartments. It can be of any form, shape and material which is suitable for hold the composition, e.g. without allowing the release of the composition to release of the composition from the pouch prior to water contact. The pouch is made from water soluble film which encloses an inner volume. Said inner volume can be divided into compartments of the pouch. Preferred films are polymeric materials preferably polymers which are formed into a film or sheet. Preferred polymers, copolymers or derivates thereof are selected polyacrylates, and water soluble acrylate copolymers, methyl cellulose, carboxy methyl cellulose, sodium dextrin, ethyl cellulose, hydroxyethyl cellulose, hydroxypropyl methyl cellulose, malto dextrin, poly methacrylates, most preferably polyvinyl alcohol copolymers and, hydroxypropyl methyl cellulose (HPMC). Preferably the level of polymer in the film for example PVA is at least about 60%. Preferred average molecular weight will typically be about 20,000 to about 150,000. Films can also be of blended compositions comprising hydrolytically degradable and water soluble polymer blends such as polylactide and polyvinyl alcohol (known under the Trade reference M8630 as sold by Mono-Sol LLC, Indiana, USA) plus plasticisers like glycerol, ethylene glycerol, propylene glycol, sorbitol and mixtures thereof. The pouches can comprise a solid laundry cleaning composition or part components and/or a liquid cleaning composition or part components separated by the water soluble film. The compartment for liquid components can be different in composition than compartments containing solids: US2009/0011970 A1.

Detergent ingredients can be separated physically from each other by compartments in water dissolvable pouches or in different layers of tablets. Thereby negative storage interaction between components can be avoided. Different dissolution profiles of each of the compartments can also give rise to delayed dissolution of selected components in the wash solution.

The detergent composition, when in liquid form, may be aqueous, typically containing at least 20% by weight and up to 95% water, such as up to about 70% water, up to about 65% water, up to about 55% water, up to about 45% water, up to about 35% water. Other types of liquid carriers, including without limitation, alkanols, amines, diols, ethers and polyols may be included in the liquid detergent composition. The liquid detergent composition may contain from 0-30% organic solvent.

The liquid detergent composition may also be non-aqueous.

The detergent composition may be a laundry soap bar. The enzyme preparation of the invention may be added to laundry soap bars and used for hand washing laundry, fabrics and/or textiles. The term laundry soap bar includes laundry bars, soap bars, combo bars, syndet bars and detergent bars. The types of bar usually differ in the type of surfactant they contain, and the term laundry soap bar includes those containing soaps from fatty acids and/or synthetic soaps. The laundry soap bar has a physical form which is solid and not a liquid, gel or a powder at room temperature. The term solid is defined as a physical form which does not significantly change over time, i.e. if a solid object (e.g. laundry soap bar) is placed inside a container, the solid object does not change to fill the container it is placed in. The bar is a solid typically in bar form but can be in other solid shapes such as round or oval.

The laundry soap bar may contain one or more additional enzymes, protease inhibitors such as peptide aldehydes (or hydrosulfite adduct or hemiacetal adduct), boric acid, borate, borax and/or phenylboronic acid derivatives such as 4-formylphenylboronic acid, one or more soaps or synthetic surfactants, polyols such as glycerine, pH controlling compounds such as fatty acids, citric acid, acetic acid and/or formic acid, and/or a salt of a monovalent cation and an organic anion wherein the monovalent cation may be for example $Na^+$, $K^+$ or $NH4^+$ and the organic anion may be for example formate, acetate, citrate or lactate such that the salt of a monovalent cation and an organic anion may be, for example, sodium formate.

The laundry soap bar may also contain complexing agents like EDTA and HEDP, perfumes and/or different type of fillers, surfactants e.g. anionic synthetic surfactants, builders, polymeric soil release agents, detergent chelators, stabilizing agents, fillers, dyes, colorants, dye transfer inhibitors, alkoxylated polycarbonates, suds suppressers, structurants, binders, leaching agents, bleaching activators, clay soil removal agents, anti-redeposition agents, polymeric dispersing agents, brighteners, fabric softeners, perfumes and/or other compounds known in the art.

The laundry soap bar may be processed in conventional laundry soap bar making equipment such as but not limited to: mixers, plodders, e.g a two stage vacuum plodder, extruders, cutters, logo-stampers, cooling tunnels and wrappers. The invention is not limited to preparing the laundry soap bars by any single method. The premix of the invention may be added to the soap at different stages of the process. For example, the premix containing a soap, enzyme preparation, optionally one or more additional enzymes, a protease inhibitor, and a salt of a monovalent cation and an organic anion may be prepared and and the mixture is then plodded. The enzyme preparation and optional additional enzymes may be added at the same time as the protease inhibitor for example in liquid form. Besides the mixing step and the plodding step, the process may further comprise the steps of milling, extruding, cutting, stamping, cooling and/or wrapping.

The detergent composition of the present invention may be used for cosmetic formulations, which may be in the form of a mousse, a gel, a spray or a lacquer and may be used in rinse-out or leave-in application.

The detergent composition may be used as hair products, especially rinse-out or leave-in products, and in particular for washing, caring for and/or conditioning the hair, holding the hairstyle, and shaping, dyeing, bleaching, permanently reshaping or relaxing the hair.

The detergent composition of the invention may also be used as care or hygiene products such as protective, treating or care creams for the face, the hands or the body, protective or care body milks, gels or mousses for caring for or cleansing the skin, or alternatively as products for making up or for removing makeup from the skin, the lips, the nails and the eyelashes.

Experimental Part

The disclosure will now be illustrated with working examples, which is intended to illustrate the working of disclosure and not intended to take restrictively to imply any limitations on the scope of the present disclosure. Other examples are also possible which are within the scope of the present disclosure.

Materials:

Standard liquid laundry detergent base (prepared in laboratory)

Different guars 250 ppm hard water

Savinase Ultra 16 L (protease)

Standard stains from suppliers are cut into 5 cm×5 cm swatches

Experimental Procedure:

Step 1. Prepare the Standard Liquid Laundry Detergent Base and Guar Solution

The standard liquid laundry detergent base was prepared in advance using the formulation below:

| Chemical name | Chemistry | % (excl. activity) | Actual weight (g) |
|---|---|---|---|
| Rhodasurf LA-9 (100%) | Alcohol ethoxylate (9EO) | 2 | 8 |
| Rhodapex N70K (70%) | Sodium laureth sulphate | 10 | 57.2 |
| Rhodacal SS40/A (40%) | Sodium dodecylbenzene sulphonate | 2 | 20 |
| Sodium citrate dehydrate (100%) | Buffer | 1 | 4 |
| Deionised water | solvent | balance | 310.8 |
| | | | 400 |

Hydrated guar solution was prepared as follows: the guar was dispersed in water first at a temperature of 25° C., by adding guar powder into distilled water while stirring continuously. Then, pH was adjusted to 4-5 using HCl. Continued stirring for another 10 minutes. Calculated amount of detergent, enzyme and the guar solution were added into the pots for washing.

Step 2. Measure Reflectance (Before Washing)

CIELAB (L*a*b*) spectrophotometer was used after calibration to measure reflectance of the fabric. 5 measurement points have been taken at different spots for each fabric.

Step 3. Wash the Fabrics

Fabrics were washed as follows:

| | |
|---|---|
| Instrument | Launderometer (SDL Atlas Rotawash M228) |
| Temperature | 30° C. |
| Washing time | 60 mins |
| Water dosage per pot | 500 g |
| Detergent | standard liquid detergent base |
| Detergent dosage | 1.5 g/L |
| Stains | Egg yolk, Choco soymilk, Coffee with milk |

1. Based on the parameters, calculated amount of standard liquid laundry detergent base, enzyme and the guar solution were added into the pots.
2. Final pH of all the wash solution was adjusted to 8-9 to optimize the enzyme efficiency.
3. After washing, the fabric was squeezed.
4. For rinsing, the fabric was placed in a clean beaker with approximately 500 mL tapwater and agitated by hand for 10 sec. Repeated twice.
5. After rinsing, the fabric was squeezed.
6. Dried at room temperature overnight on an aluminium foil.

Step 4. Measure Reflectance (after Drying)

CIELAB (L*a*b*) spectrophotometer has been used as in Step 2.

Step 5. Calculate Color Difference/Soil Removal Percentage/Whiteness Index

Average L*, a* and b* values for each textile swatch before and after wash have been calculated. Color difference (ΔE), soil removal % (SRP) and whiteness index (SRI) have been calculated with the averaged L*a*b values in the equations below:

$$\Delta E = \sqrt{(L_{washed} - L_{stained})^2 + (a_{washed} - a_{stained})^2 + (b_{washed} - b_{stained})^2}$$

$$SRP = \frac{\sqrt{(L_{washed} - L_{stained})^2 + (a_{washed} - a_{stained})^2 + (b_{washed} - b_{stained})^2}}{\sqrt{(L_{washed} - L_{white})^2 + (a_{stained} - a_{white})^2 + (b_{stained} - b_{white})^2}}$$

$$SRI = 100 - \sqrt{(L_{washed} - L_{white})^2 + (a_{washed} - a_{white})^2 + (b_{washed} - b_{white})^2}$$

Results

Results are expressed in the table as follows:

TABLE 1

| Components (wt %) | Control | Ex. 1 | Ex. 2 | Com. Ex. 1 | Com. Ex. 2 | Com. Ex. 3 |
|---|---|---|---|---|---|---|
| Detergent base Fragrance Free | 0.15 | 0.15 | 0.15 | 0.15 | 0.15 | 0.15 |
| Enzyme, Savinase Ultra 16L | 0.0015 | 0.0015 | 0.0015 | 0.0015 | 0.0015 | 0 |
| Amphoteric PS1 | — | 0.00075 | — | — | — | — |

TABLE 1-continued

| Components (wt %) | Control | Ex. 1 | Ex. 2 | Com. Ex. 1 | Com. Ex. 2 | Com. Ex. 3 |
|---|---|---|---|---|---|---|
| Amphoteric PS2 | — | — | 0.00075 | — | — | — |
| Cationic PS | — | — | — | 0.00075 | — | — |
| Anionic PS | — | — | — | — | 0.00075 | — |
| Water | To 100 | To 100 | To 100 | To 100 | To 100 | To 100 |
| Relative ΔE improvement vs. Control | — | +3% | +3.6% | −7% | 0 | −14.3% |

Amphoteric PS (polysaccharide) 1 is a carboxymethyl hydroxypropyltrimethylammonium chloride guar having an average molecular weight of about 2,000,000 Daltons and having a cationic Degree of Substitution of 0.09 and an anionic Degree of Substitution of 0.17, available from Solvay.
Amphoteric PS2 is a carboxymethyl hydroxypropyltrimethylammonium chloride guar having an average molecular weight of about 2,000,000 Daltons and having a cationic Degree of Substitution of 0.045 and an anionic Degree of Substitution of 0.17, available from Solvay.
Cationic PS is a guar hydroxypropyl trimonium chloride having an average molecular weight of about 500,000 Daltons and having a Cationic degree of Substitution of about 0.13, available from Solvay.
Anionic PS is a carboxymethyl hydroxypropyl guar having an average molecular weight of about 2,000,000 Daltons and having an anionic Degree of Substitution of about 0.17, available from Solvay.

Results showed that amphoteric guars according to the present invention led to more significant Delta E compared to the benchmark (without any guar) or the comparatives compositions which comprise a cationic guar or an anionic guar. This demonstrates that the amphoteric guars can enhance detergent properties of enzymes for fabrics, which leads in turn to enhancement in the cleaning performance of the enzyme-containing detergent composition.

The invention claimed is:

1. A method for enhancing the detergent properties of enzymes of a detergent composition having at least one enzyme, comprising the step of adding to said composition an amphoteric polysaccharide, wherein the amphoteric polysaccharide has a $DS_{anionic}$ value greater than its $DS_{cationic}$ value, the $DS_{anionic}$ value is from 0.01 to 0.2, and the $DS_{cationic}$ value is from 0.001 to 0.1, and an enzyme having detergent properties wherein the enzyme is 1.0-5.0 wt. % of the detergent composition.

2. A composition comprising at least a detergent, an enzyme having detergent properties wherein the enzyme is 1.0-5.0 wt. % of the detergent composition, and an amphoteric polysaccharide, wherein the amphoteric polysaccharide has a $DS_{anionic}$ value greater than its $DS_{cationic}$ value, and the amphoteric polysaccharide has a $DS_{cationic}$ value of 0.001 to 0.1.

3. The method according to claim 1 wherein the enzyme is 1.0-1.5 wt. % of the detergent composition.

4. The composition according to claim 2 wherein the enzyme is 1.0-1.5 wt. % of the detergent composition.

* * * * *